US008075360B2

(12) United States Patent
Teramoto et al.

(10) Patent No.: US 8,075,360 B2
(45) Date of Patent: Dec. 13, 2011

(54) ELECTRON-EMITTING DEVICE, ELECTRON SOURCE, IMAGE DISPLAY APPARATUS, AND MANUFACTURING METHOD OF ELECTRON-EMITTING DEVICE

(75) Inventors: Yoji Teramoto, Ebina (JP); Ryoji Fujiwara, Chigasaki (JP); Michiyo Nishimura, Sagamihara (JP); Kazushi Nomura, Sagamihara (JP); Shunsuke Murakami, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/253,668

(22) Filed: Oct. 17, 2008

(65) Prior Publication Data

US 2009/0111350 A1 Apr. 30, 2009

(30) Foreign Application Priority Data

Oct. 24, 2007 (JP) ..... 2007-276269

(51) Int. Cl.
*H01J 1/304* (2006.01)
*H01J 9/12* (2006.01)

(52) U.S. Cl. ..... 445/51; 445/50; 313/309; 313/495

(58) Field of Classification Search ..... 313/495, 313/496, 309, 310, 311; 445/50, 51
See application file for complete search history.

(56) References Cited

U.S. PATENT DOCUMENTS 5,180,951 A 1/1993 Dworsky et al.
5,283,501 A 2/1994 Zhu et al.
5,851,917 A * 12/1998 Lee ..... 438/627
6,267,636 B1 7/2001 Onishi et al. ..... 445/6
6,372,304 B1 * 4/2002 Sano et al. ..... 427/571
6,379,211 B2 4/2002 Onishi et al. ..... 445/73
6,504,159 B1 * 1/2003 Keller ..... 250/423 R
6,717,340 B2 4/2004 Nishimura et al. ..... 313/310
6,853,126 B2 2/2005 Nomura ..... 313/492
6,975,288 B2 12/2005 Nishimura et al. ..... 345/74.1

(Continued)

FOREIGN PATENT DOCUMENTS

CN 1252615 A 5/2000

(Continued)

OTHER PUBLICATIONS

Zhirnov et al, Environmental effect on the electron emission from diamond surfaces, J. Vac. Sci. Technol. B16(3), May/Jun. 1998, pp. 1188-1193.

*Primary Examiner* — Karabi Guharay
(74) *Attorney, Agent, or Firm* — Fitzpatrick, Cella, Harper & Scinto

(57) ABSTRACT

A manufacturing method of an electron-emitting device including the steps of: preparing a base substrate provided with an insulating or semi-conducting layer in advance and exposing the layer to an atmosphere which contains neutral radical containing hydrogen. It is preferable that the insulating or semi-conducting layer contains metal particles; the insulating or semi-conducting layer is a film containing carbon as a main component; the neutral radical containing hydrogen contains any of H., $CH_3$., $C_2H_5$., and $C_2H$. or mixture gas thereof; compared with a density of a charged particle in the atmosphere, a density of the neutral radical containing hydrogen in the atmosphere is more than 1,000 times; and a step of exposing the insulating or semi-conducting layer to the atmosphere is a step of making a hydrogen termination by using a plasma apparatus provided with a bias grid.

11 Claims, 6 Drawing Sheets

U.S. PATENT DOCUMENTS

| | | | | |
|---|---|---|---|---|
| 7,021,981 | B2 | 4/2006 | Onishi et al. | 445/6 |
| 7,074,102 | B2 | 7/2006 | Teramoto | 445/24 |
| 7,109,663 | B2 | 9/2006 | Fujiwara et al. | 315/169.4 |
| 7,259,520 | B2 | 8/2007 | Fujiwara et al. | 315/169.1 |
| 7,391,150 | B2 | 6/2008 | Nomura | 313/497 |
| 7,405,092 | B2 | 7/2008 | Nishimura | 438/20 |
| 7,435,689 | B2 | 10/2008 | Teramoto | 438/750 |
| 7,456,565 | B2 | 11/2008 | Nomura et al. | 313/497 |
| 2003/0181060 | A1* | 9/2003 | Asai et al. | 438/758 |
| 2004/0007177 | A1* | 1/2004 | Ohmi et al. | 118/715 |
| 2005/0199586 | A1* | 9/2005 | Matsushita et al. | 216/67 |
| 2005/0202745 | A1 | 9/2005 | Nishimura | 445/5 |
| 2006/0066199 | A1 | 3/2006 | Ichikawa et al. | 313/311 |
| 2006/0125370 | A1 | 6/2006 | Nishimura et al. | 313/310 |
| 2007/0188068 | A1 | 8/2007 | Murakami | 313/310 |
| 2007/0257593 | A1 | 11/2007 | Murakami | 313/311 |
| 2008/0012463 | A1 | 1/2008 | Fujiwara et al. | 313/310 |
| 2008/0070468 | A1 | 3/2008 | Ichikawa et al. | 445/51 |
| 2009/0026914 | A1 | 1/2009 | Nomura et al. | 313/498 |

FOREIGN PATENT DOCUMENTS

| | | |
|---|---|---|
| JP | 09-199001 | 7/1997 |
| JP | 10-081971 | 3/1998 |
| JP | 10-283914 | 10/1998 |
| JP | 2006-134724 | 5/2006 |

* cited by examiner

ELECTRON-EMITTING DEVICE, ELECTRON SOURCE, IMAGE DISPLAY APPARATUS, AND MANUFACTURING METHOD OF ELECTRON-EMITTING DEVICE

BACKGROUND OF THE INVENTION

1. Field of the Invention

The present invention relates to a manufacturing method of an electron-emitting device, the electron-emitting device, an electron source having the electron-emitting device, and an image display apparatus having the electron source.

2. Description of the Related Art

There is a field emission type (FE type) and a surface conduction type or the like in the electron-emitting device.

In the FE type electron-emitting device, by applying a voltage between a cathode electrode (and an electron-emitting film arranged on the cathode electrode) and a gate electrode, an electron is pulled out from the cathode electrode (or the electron-emitting film) into vacuum. Therefore, an operation electric field largely depends on a work function of a cathode electrode (an electron-emitting film) to be used and its shape or the like. Generally, it is necessary to select the cathode electrode (the electron-emitting film) having a small work function.

Diamond, of which surface is terminated with hydrogen, is typical as a material having a negative electron affinity, and an electron-emitting device using a diamond surface having a negative electron affinity as an electron-emitting surface is disclosed in a specification of U.S. Pat. No. 5,283,501, a specification of U.S. Pat. No. 5,180,951, and V. V. Zhinov, J. Liu et al, "Environmental effect on the electron emission from diamond surfaces", J. Vac. Sci. Technol., B16 (3), May/June 1998, pp. 1188 to 1193.

In addition, as a method for terminating a surface of diamond with hydrogen, a method using a plasma of hydrogen and a plasma of a compound containing hydrogen is disclosed in Japanese Patent Application Laid-Open (JP-A) No. 2006-134724. Then, a method for carrying out hydrogen termination by using electron cyclotron resonance (ECR) plasma is disclosed in Japanese Patent Application Laid-Open (JP-A) No. 10-283914. In addition, in the case of growing diamond by a plasma CVD, it is considered that a neutral radical $CH_3$. ("." means radical) is largely involved in growth of diamond in the process of the growth of diamond.

However, it is difficult to manufacture diamond on a large area with a uniform film thickness, so that it is difficult to manufacture an electron-emitting device uniformly on a large area. Further, the emitted electrons are diffused because a surface roughness is large, so that it is difficult to display a high-definition image.

In addition, in Japanese Patent Application Laid-Open (JP-A) No. 10-081971, a method is disclosed, which forms a film made of $SiO_2$ by complementing a charged particle in an ECR plasma with a mesh and selecting only a neutral particle in an apparatus using an ECR plasma.

SUMMARY OF THE INVENTION

The present invention has been made to solve the foregoing problems and an object of which is to provide an electron-emitting device, which can emit an electron with a small electron beam diameter in a low electric field.

In addition, a further object of the present invention is to provide an electron-emitting device of a field emission type, which can perform a high-efficient emission of an electron with a low voltage and of which manufacturing process is simple, an electron source, and an image display apparatus.

A manufacturing method of an electron-emitting device according to the present invention is characterized by having a step of preparing a base substrate provided with an insulating or semi-conducting layer and a step of exposing the layer to an atmosphere which contains neutral radical containing hydrogen.

In addition, an electron-emitting device according to the present invention is characterized by being manufactured by the manufacturing method of the electron-emitting device according to the present invention.

In addition, an electron source according to the present invention is characterized by having a plurality of the electron-emitting devices according to the present invention.

In addition, an image display apparatus according to the present invention is characterized by having the electron source according to the present invention and a light-emitting member, which emits light due to irradiation of electrons.

According to the present invention, it is possible to provide an electron-emitting device, which can emit an electron in a low electric field. Further, it is possible to provide an electron-emitting device capable of emitting an electron, of which a beam diameter is small, with a high efficiency in a low electric field, and the electron-emitting device can be manufactured by a simple process.

In addition, if the electron-emitting device according to the present invention is applied to the electron source and the image display apparatus, it is possible to realize an electron source and an image display apparatus, which are excellent in capability.

Further features of the present invention will become apparent from the following description of exemplary embodiments with reference to the attached drawings.

DESCRIPTION OF THE EMBODIMENTS

With reference to the drawings, a preferable embodiment of this invention will be described with an example in detail below. However, a scope of this invention is not limited to a measurement, a material, a shape, and its relative arrangement or the like of a constituent part described in this embodiment unless there is a description in particular.

Figure 1:
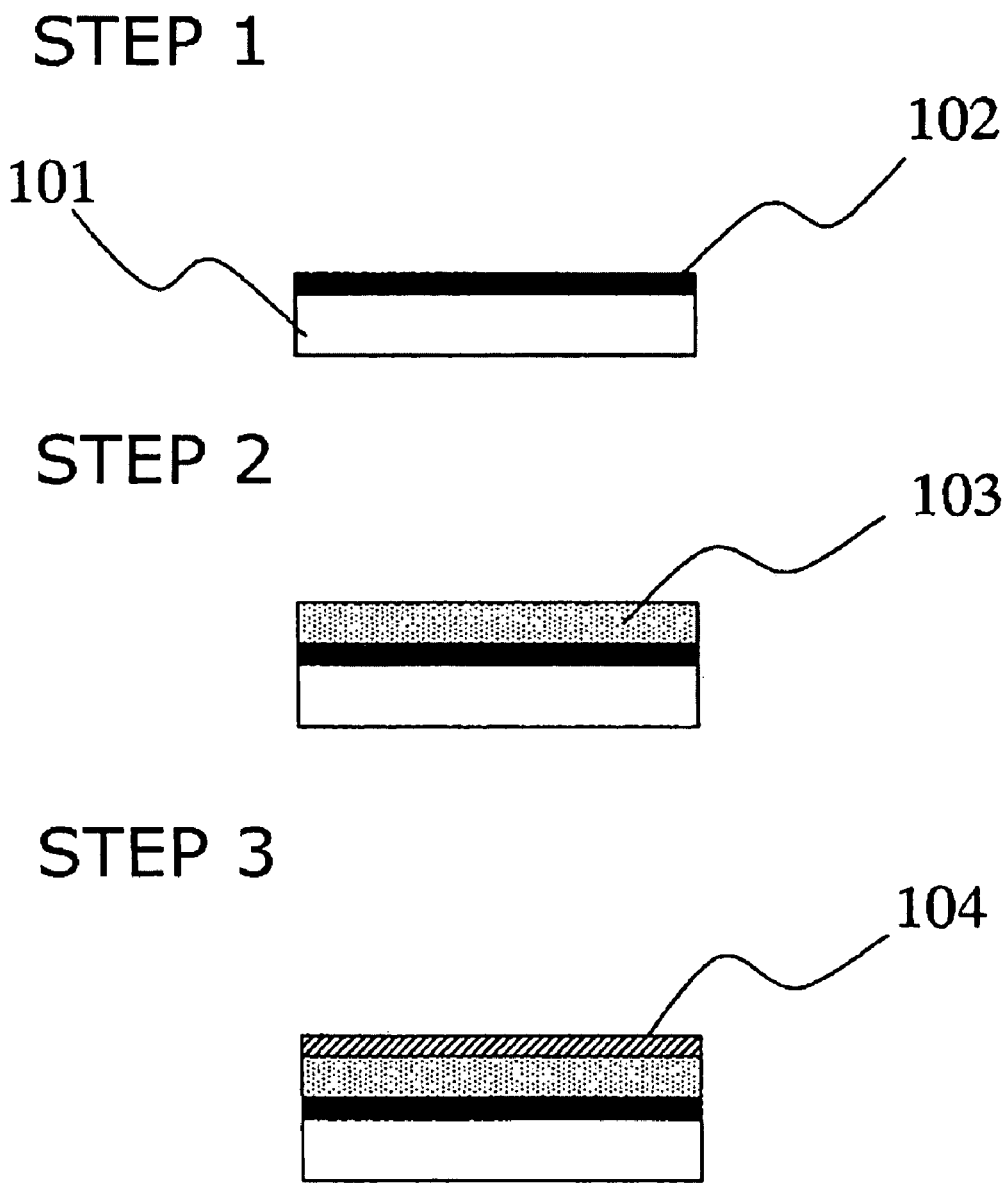
FIG. 1 shows a flow of a manufacturing method of an electron-emitting film.

FIG. 1 shows a flow of a manufacturing method of an electron-emitting film according to the present embodiment.

In FIG. 1, a step 1 is a step to prepare a substrate and form a film of a cathode electrode, a step 2 is a step to form an electron-emitting film on the substrate, and a step 3 is a step to terminate a surface of the electron-emitting film with hydrogen (the surface termination processing).

Figure 2:
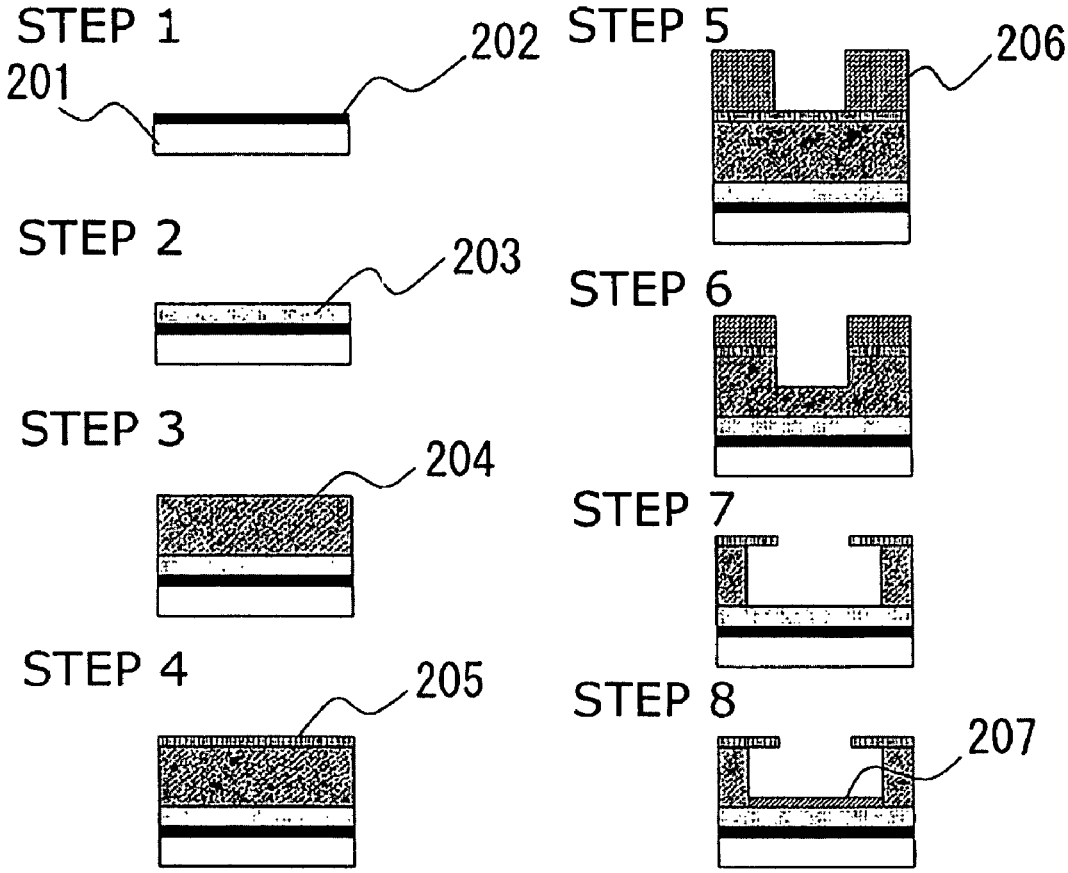
FIG. 2 shows a flow of a manufacturing method of an electron-emitting device.

FIG. 2 shows a flow of a manufacturing method of an electron-emitting device according to the present embodiment.

In FIG. 2, a step 1 is a step to prepare a base substrate and form a film of a cathode electrode; a step 2 is a step to form an electron-emitting film on the substrate; a step 3 is a step to form an insulating film on the electron-emitting film; a step 4 is a step to form a film of a gate electrode on the insulating film; a step 5 is a step to carry out patterning by a photoresist in order to form an opening; a step 6 is a step to partially etch the gate electrode and the insulating film by dry etching; a step 7 is a step to partially expose the electron-emitting film by removing the insulating film by wet etching; and a step 8 is a step to terminate a part of the surface of the electron-emitting film with hydrogen (the surface termination processing).

Figure 4:
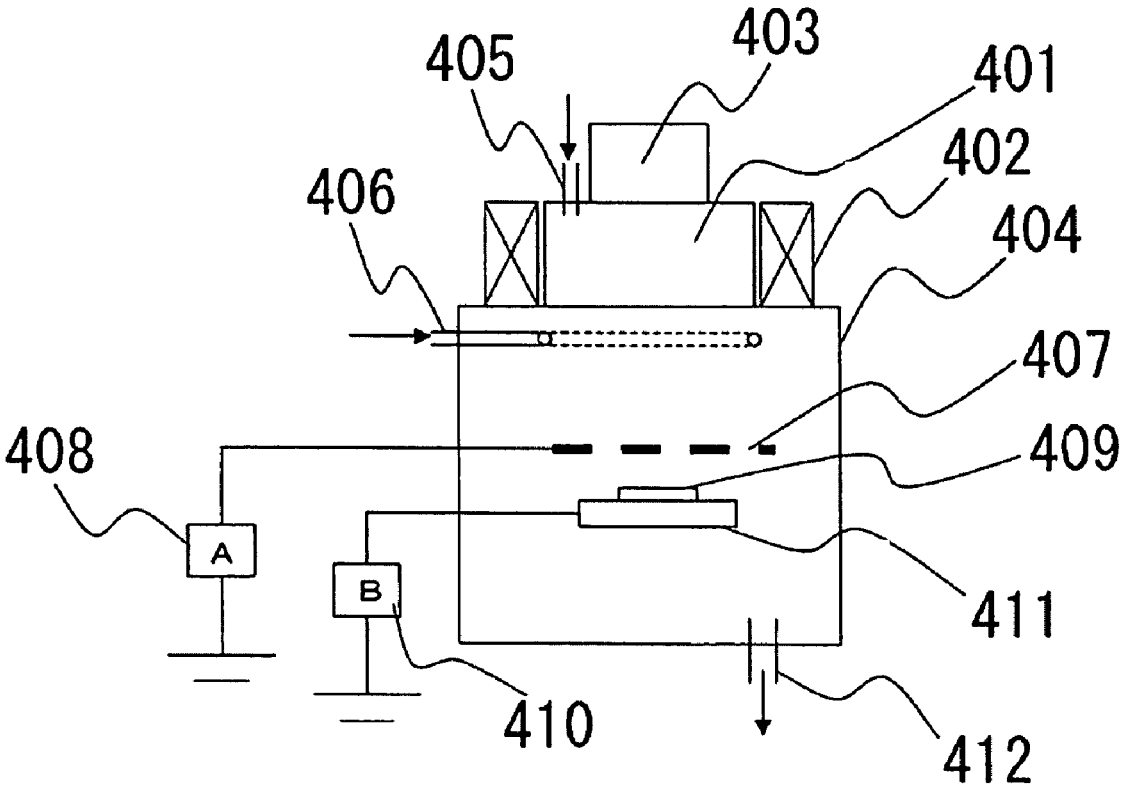
FIG. 4 is a schematic view showing a structure of a surface processing apparatus.

FIG. 4 is a schematic view showing a structure of the most base surface processing apparatus.

As shown in FIG. 4, a surface processing apparatus is provided with two chambers, namely, a plasma generation chamber 401 and a sample chamber 404. Then, as a power source, the surface processing apparatus is provided with a direct current power source A 408 and a direct current power source B 410. Further, the surface processing apparatus is provided with a magnetic coil 402, a microwave entrance 403, a processing gas entrance A 405, a processing gas entrance B 406, a bias grid 407, and an exhaust opening 412 to terminate the surface of a surface processing sample 409 mounted in the sample chamber 404 with hydrogen. Further, as necessary, a substrate heater 411 may be provided.

<Manufacturing Method of an Electron-Emitting Film>

Hereinafter, a manufacturing method of an electron-emitting film according to the present embodiment will be described with reference to FIG. 1.

(Step 1)

At first, a cathode electrode 102 is laminated on a substrate 101, of which surface is sufficiently cleaned. The substrate 101 includes a quartz glass, a glass having a reduced content of impurity such as Na, a Soda-lime glass, a laminated body having $SiO_2$ laminated on a silicone substrate by a sputtering method or the like, and an insulating substrate made of a ceramics such as alumina, for example.

Generally, the cathode electrode 102 has a conductive property and is formed by a general vacuum film formation technique such as an evaporation method and a sputtering method, and a photolithography technique. For example, a material of the cathode electrode 102 is a metal such as Be, Mg, Ti, Zr, Hf, V, Nb, Ta, Mo, W, Al, Cu, Ni, Cr, Au, Pt, and Pd, or an alloy material. The thickness of the cathode electrode 102 is determined in the range of several ten nm to several mm, and preferably, the thickness of the cathode electrode 102 is selected in the range of several hundred nm to several μm.

(Step 2)

Next, an insulating or semi-conducting layer is formed on the surface of the cathode electrode. This layer (film) is generally referred to as an electron-emitting film 103. The electron-emitting film 103 is formed by a general vacuum film formation technique such as an evaporation method and a sputtering method, and a photolithography technique. In addition, as other method, by dispersing metal particles in a polymer, it is possible to form the electron-emitting film 103. It is preferable that the electron-emitting film 103 is a film containing carbon as a main component, and specifically, it is preferable that the electron-emitting film 103 is a film composed of a carbon, a carbon composition, or a layer thereof containing dispersed metal particle. The size of the dispersed metal particle is determined in the range of several nm to several hundred nm, and preferably, the size is selected in the range of several nm to several ten nm. In addition, it is preferable that the density of the metal particle in the electron-emitting film is in the range of not less than $1\times10^{14}/cm^3$ not more than $1\times10^{19}/cm^3$. As a material of the metal particle, for example, a metal such as Be, Mg, Mn, Ti, Zr, Hf, V, Nb, Ta, Mo, W, Al, Cu, Ni, Cr, Co, Fe, Ni, Au, Pt, and Pd or an alloy material may be considered. A carbon material may be appropriately selected from the group consisting of, for example, a graphite, a fullerene, a carbon nano tube, a diamond-like carbon, an amorphous carbon, a hydrogenated amorphous carbon, a carbon having diamond dispersed therein, a carbon composition, and mixtures thereof. Preferably, the carbon material may be a material having a low work function such as a diamond thin film and a diamond-like carbon or the like. The film thickness of the electron-emitting film 103 is determined in the range of several nm to several μm, and preferably, the film thickness of the electron-emitting film 103 is selected in the range of several nm to several hundred nm. Hereinafter, the object manufactured up to step 2 will be referred to as a base substrate.

(Step 3)

Next, the surface of the electron-emitting film is terminated with hydrogen. FIG. 4 shows an example of a method of carrying out hydrogen termination. The apparatus shown in FIG. 4 is a surface processing apparatus using ECR plasma, and a plasma generation chamber is arranged on a sample chamber. If a magnetic field of a magnetic flux density 875 G (Gauss) meeting an ECR requirement is applied in a plasma generation chamber and a microwave is introduced, plasma is generated. According to the apparatus shown in FIG. 4, a divergent magnetic field, in which a magnetic field distribution of a magnetic coil becomes lower as it moves toward a sample chamber, is formed. A bias grid 407 is arranged above the surface of the base substrate. Specifically, the bias grid 407 is arranged between the ECR plasma generation chamber 401 and the surface processing sample 409, and by this bias grid, a charge particle in the plasma is captured so as to allow neutral radical containing hydrogen to selectively pass there through. Thereby, this neutral radical is irradiated on the surface of the sample. In other words, the surface of the sample is exposed to the atmosphere containing this neutral radical. Therefore, it is possible to efficiently terminate the surface of the sample with hydrogen. For an introduction of the processing gas, a processing gas entrance A and a processing gas entrance B are used. As the processing gas, a gas containing hydrogen is used. For example, this processing gas is appropriately selected from the group consisting of a hydrogen gas or a hydrocarbon gas. Specifically, a gas such as $H_2$, $CH_4$, and $C_2H_4$ or mixture gas thereof may be used as a processing gas. Then, by generating plasma in those processing gas, as a neutral radical containing hydrogen, any of H., $CH_3$., $C_2H_5$., and $C_2H$. can be generated.

The bias grid has a conductive property and is formed in a mesh-like structure. The size of the opening of this mesh is determined in the range of 1 μm to 10 cm, and preferably, in the range of 10 μm to 10 mm. Under such a condition, by selectively removing a charged particle in plasma, the density of the neutral radical in the atmosphere can be kept stable. Compared with a density of the charged particle, the density of the neutral radical is more than 1,000 times. In addition, a plasma source can be appropriately selected from the group consisting of high frequency plasma, remote plasma, and microwave plasma or the like.

Further, a potential of a bias grid (a grid bias) may be equipotential or negative to an earth. A range of the potential is determined in the range of 0 to −500 V, and preferably, the potential is selected in the range of 0 to −200 V. In addition, a surface potential of a sample (a substrate bias) is determined by a direct current power source B. The surface potential of the sample may be equipotential or negative to a grid bias, a range of the potential is determined in the range of 0 to 1,000 V, and preferably, the potential is selected in the range of 0 to 500 V.

Further, the processing gas may be a mixture gas made of plural kinds of gases. The processing pressure is determined in the range such that plasma can be maintained, and preferably, the processing pressure is determined in the range of 0.05 to 10 Pa.

Further, the base substrate may be heated by the substrate heater 411.

<Manufacturing Method of an Electron-Emitting Device>

Hereinafter, with reference to FIG. 2, a manufacturing method of an electron-emitting device will be described.

(Step 1)

At first, a cathode electrode 202 is laminated on a substrate 201, of which surface is sufficiently cleaned. The substrate 201 is a quartz glass, a glass having a contained amount of impurity such as Na reduced, a Soda-lime glass, a laminated body having $SiO_2$ laminated on a silicone substrate by a sputtering method or the like, and an insulating substrate made of a ceramics such as alumina, for example.

Generally, the cathode electrode 202 has a conductive property and is formed by a general vacuum film formation technique such as an evaporation method and a sputtering method, and a photolithography technique. For example, a material of the cathode electrode 202 is a metal such as Be, Mg, Ti, Zr, Hf, V, Nb, Ta, Mo, W, Al, Cu, Ni, Cr, Au, Pt, and Pd, or an alloy material. The thickness of the cathode electrode 202 is determined in the range of several ten nm to several mm, and preferably, the thickness of the cathode electrode 202 is selected in the range of several hundred nm to several μm.

(Step 2)

Next, an insulating or semi-conducting layer is formed on the surface of the cathode electrode. This layer (film) is generally referred to as an electron-emitting film 203. The electron-emitting film 203 is formed by a general vacuum film formation technique such as an evaporation method and a sputtering method, and a photolithography technique. In addition, as other method, by dispersing metal particles in a polymer, it is possible to form the electron-emitting film 103. It is preferable that the electron-emitting film 203 is a film containing carbon as a main component, and specifically, it is preferable that the electron-emitting film 203 is a film composed of a carbon, a carbon composition, or a layer thereof containing dispersed metal particle. The size of the dispersed metal particle is determined in the range of several nm to several hundred nm, and preferably, the size is selected in the range of several nm to several ten nm. In addition, it is preferable that the density of the metal particle in the electron-emitting film is in the range of not less than $1\times10^{14}/cm^3$ not more than $1\times10^{19}/cm^3$. As a material of the metal particle, for example, a metal such as Be, Mg, Mn, Ti, Zr, Hf, V, Nb, Ta, Mo, W, Al, Cu, Ni, Cr, Co, Fe, Ni, Au, Pt and Pd or an alloy material may be considered. A carbon material may be appropriately selected from the group consisting of, for example, a graphite, a fullerene, a carbon nano tube, a diamond-like carbon, an amorphous carbon, a hydrogenated amorphous carbon, a carbon having diamond dispersed therein, a carbon composition, and mixture thereof. Preferably, the carbon material may be a material having a low work function such as a diamond thin film and a diamond-like carbon or the like. The film thickness of the electron-emitting film 203 is determined in the range of several nm to several μm, and preferably, the film thickness of the electron-emitting film 203 is determined in the range of several nm to several hundred nm. Hereinafter, the object manufactured up to step 2 will be referred to as a base substrate.

(Step 3)

Next, an insulating layer 204 is accumulated. The insulating layer 204 is formed by a general vacuum film formation technique such as a sputtering method, a CVD method, and a vacuum evaporation method. The thickness of the insulating layer 204 is determined in the range of several nm to several μm and preferably is selected in the range of several ten nm to several hundred nm. It is desirable that the material of the insulating layer 204 is a material with high voltage tightness, which can withstand a high electric field, for example, $SiO_2$, SiN, $Al_2O_3$, CaF, and an undoped diamond.

(Step 4)

Then, a gate electrode 205 is accumulated. The gate electrode 205 has a conductive property same as the cathode electrode 202, and the gate electrode 205 is formed by a general vacuum film formation technique such as an evaporation method and a sputtering method, and a photolithography technique. The material of the gate electrode 205 is appropriately selected from the group consisting of a metal, an alloy material, a carbide, a boride, a nitride, a semiconductor, and an organic polymer material. As a metal, for example, Be, Mg, Ti, Zr, Hf, V, Nb, Ta, Mo, W, Al, Cu, Ni, Cr, Au, Pt, and Pd may be used. As a carbide, for example, TiC, ZrC, HfC, TaC, SiC, and WC may be used. As a boride, for example, $HfB_2$, $ZrB_2$, $LaB_6$, $CeB_6$, $YB_4$, and $GdB_4$ may be used. As a nitride, for example, TiN, ZrN, and HfN may be used. As a semiconductor, Si, and Ge or the like may be used. The thickness of the gate electrode 205 is determined in the range of several nm to several ten μm, and preferably, the thickness of the gate electrode 205 is determined in the range of several ten nm to several μm.

(Step 5)

Next, a mask pattern 206 is formed by a photolithography technique.

(Step 6)

Then, using the mask pattern 206, the gate electrode 205 and the insulating layer 204 are partially removed by dry etching.

(Step 7)

Next, the insulating layer 204 is partially removed by wet etching. As a liquid to be used for wet etching, a liquid such that a rate of etching for the insulating layer 204 is higher than the rate of etching for the gate electrode 205 and the electron-emitting film 203 is preferable, and a liquid, whereby the electron-emitting film 203 is not deteriorated, is desirable.

(Step 8)

Next, the surface of the electron-emitting film is terminated with hydrogen. FIG. 4 shows an example of a method of carrying out hydrogen termination. The apparatus shown in FIG. 4 is a surface processing apparatus using ECR plasma, and a plasma generation chamber is arranged on a sample chamber. If a magnetic field of a magnetic flux density 875 G (Gauss) meeting an ECR requirement is applied in a plasma generation chamber and a microwave is introduced, plasma is generated. According to the apparatus shown in FIG. 4, a divergent magnetic field, in which a magnetic field distribution of a magnetic coil becomes lower as it moves toward a sample chamber, is formed. A bias grid 407 is arranged above the surface of the base substrate. Specifically, the bias grid 407 is arranged between the ECR plasma generation chamber 401 and the surface processing sample 409, and by this bias grid, a charge particle in the plasma is captured so as to allow neutral radical containing hydrogen to selectively pass there through. Thereby, this neutral radical is irradiated on the surface of the sample. In other words, the surface of the sample is exposed to the atmosphere containing this neutral radical. Therefore, it is possible to efficiently terminate the surface of the sample with hydrogen. For an introduction of the processing gas, a processing gas entrance A and a processing gas entrance B are used. As the processing gas, a gas containing hydrogen is used. For example, this processing gas is appropriately selected from the group consisting of a hydrogen gas or a hydrocarbon gas. Specifically, a gas such as $H_2$, $CH_4$, and $C_2H_4$ or their mixture gas may be used. Then, by generating plasma in those processing gas, as a neutral radical containing hydrogen, any of H., $CH_3$., $C_2H_5$., and $C_2H$. can be generated.

Figure 3:
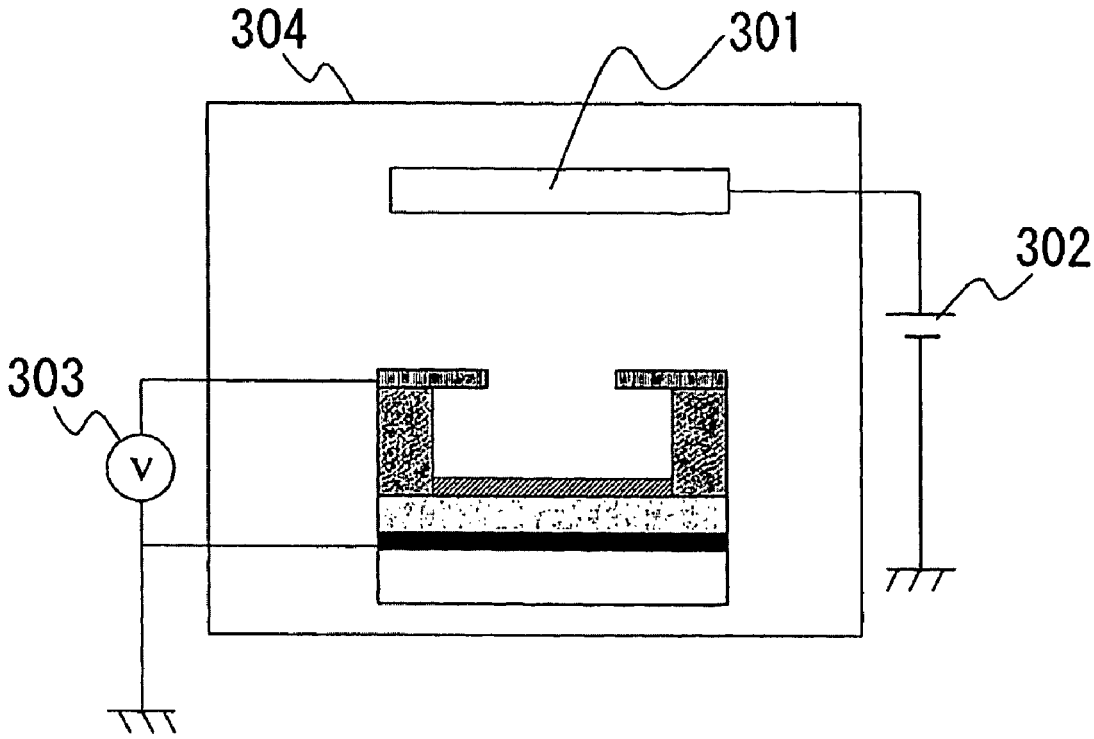
FIG. 3 is a schematic view showing a structure of an electron-emitting device.

The electron-emitting device, which has been manufactured in this way, is set within a vacuum container 304 as shown in FIG. 3. An anode electrode 301 is arranged above this electron-emitting device, a voltage is applied to the anode electrode by a high voltage power source 302, and then a voltage, which is necessary for the gate electrode and the anode electrode, respectively, is applied by a driving power source 303. Thus, it is possible to observe emission of an electron.

The bias grid has a conductive property and is formed in a mesh-like structure. The size of the opening of this mesh is determined in the range of 1 μm to 10 cm, and preferably, in the range of 10 μm to 10 mm. Under such a condition, by selectively removing a charged particle in plasma, the density of neutral radical in the atmosphere can be kept stable. Compared with a density of the charged particle, the density of the neutral radical is more than 1,000 times. In addition, a plasma source can be appropriately selected from the group consisting of high frequency plasma, remote plasma, and microwave plasma or the like.

Further, a potential of a bias grid (a grid bias) may be equipotential or negative to an earth. A range of the potential is determined in the range of 0 to −500 V, and preferably, is selected in the range of 0 to −200 V. In addition, a surface potential of a sample (a substrate bias) is determined by a direct current power source B. The surface potential of the sample may be equipotential or negative to a grid bias. A range of the potential is determined in the range of 0 to 1,000 V, and preferably, the potential is selected in the range of 0 to 500 V.

Further, the processing gas may be a mixture gas made of plural kinds of gases. The processing pressure is determined in such a range that plasma can be maintained, and preferably, in the range of 0.05 to 10 Pa.

Further, the base substrate may be heated by the substrate heater 411.

<Application>

Next, an example that the above-described electron-emitting device is applied to the electron source and the image display apparatus will be described.

(Electron Source)

Various arrangements of the electron-emitting device are employed. As an example, a plurality of the electron-emitting devices are arranged in an X direction and a Y direction in matrix. One electrodes of the plurality of electron-emitting devices in the same line are connected to a wire in the X direction in common, and other electrodes of the electron-emitting device in the same row are connected to a wire in the Y direction in common. This is referred to as a simple matrix arrangement.

Figure 5:
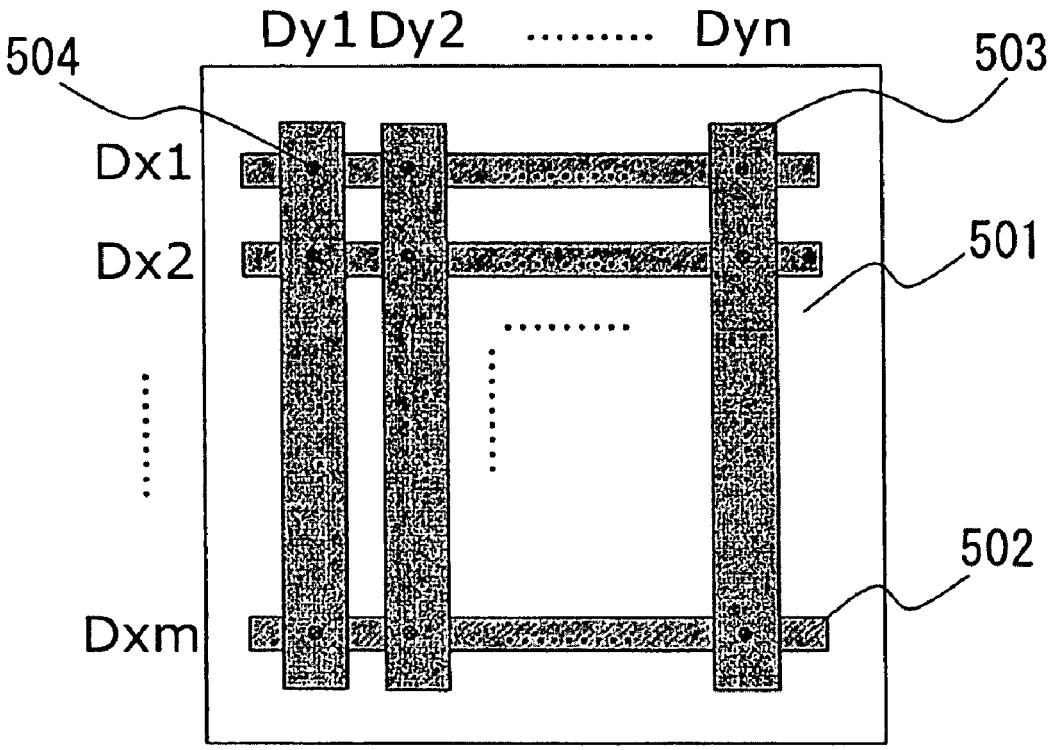
FIG. 5 is a schematic view showing a structure of an electron source.

Hereinafter, an electron source of a simple matrix arrangement, which is obtained by arranging the above-described plurality of electron-emitting devices, will be described with reference to FIG. 5. As shown in FIG. 5, the electron source is provided with a electron source base substrate 501, an X-directional wiring 502, a Y-directional wiring 503, and an electron-emitting device 504.

The X-directional wiring 502 is formed by m pieces of wires, namely, Dx1, Dx2, . . . , and Dxm, and the X-directional wiring 502 can be made of a conductive metal or the like, which is formed by using a vacuum evaporation method, a printing method, and a sputtering method or the like. The material, the film thickness, and the width of the wiring are appropriately designed. The Y-directional wiring 503 is formed by n pieces of wires, namely, Dy1, Dy2, . . . , and Dyn, and the Y-directional wiring 503 is formed in the same way as the X-directional wiring 502. An inter-layer insulating layer (not illustrated) is provided between these m pieces of X-directional wirings 502 and n pieces of Y-directional wiring 503, and the both wirings are electrically separated (both of m and n are positive integers).

The inter-layer insulating layer (not illustrated) is composed of $SiO_2$ or the like, which is formed by using a vacuum evaporation method, a printing method, and a sputtering method or the like. For example, the inter-layer insulating layer is formed in a desired shape, on the whole surface or a partial surface of the electron source base substrate 501, on which the X-directional wirings 502 are formed. Particularly, the material, the film thickness, and the manufacturing method of the inter-layer insulating layer are appropriately designed so as to endure a potential difference in a cross portion between the X-directional wiring 502 and the Y-directional wiring 503. The X-directional wiring 502 and the Y-directional wiring 503 are pulled out as an external terminal, respectively.

The electron-emitting device 504 is provided with a pair of electrodes (a gate electrode and a cathode electrode). According to the example shown in FIG. 5, the gate electrode is electrically connected by wire connection between any one of n pieces of the Y-directional wirings 503 and a conductive metal or the like. The cathode electrode is electrically connected by wire connection between any one of m pieces of the X-directional wirings 502 and a conductive metal or the like.

The constituent elements of the materials to form the X-directional wiring 502 and the Y-directional wiring 503, the material to form the wire connection, and the material to form a pair of device electrodes may be partially or entirely the same or may be different, respectively. These materials may be appropriately selected from the group consisting of the materials of the above-described device electrodes, for example. In the case that the material to form the device electrode and the wiring material are the same, the wiring connected to the device electrode may be made into an device electrode.

A scanning signal applying means (not illustrated) is connected to the X-directional wiring 502. The scanning signal applying means may apply a scanning signal to the electron-emitting device 504, which is connected to the selected X-directional wiring. On the other hand, a modulation signal generation means (not illustrated) is connected to the Y-directional wiring 503. The modulation signal generation means may apply a modulation signal, which is modulated in accordance with an input signal, to each row of the electron-emitting device 504. A driving voltage to be applied to each electron-emitting device may be supplied as a difference voltage between the scanning signal and the modulation signal to be applied to this device.

(Image Display Apparatus)

Figure 6:
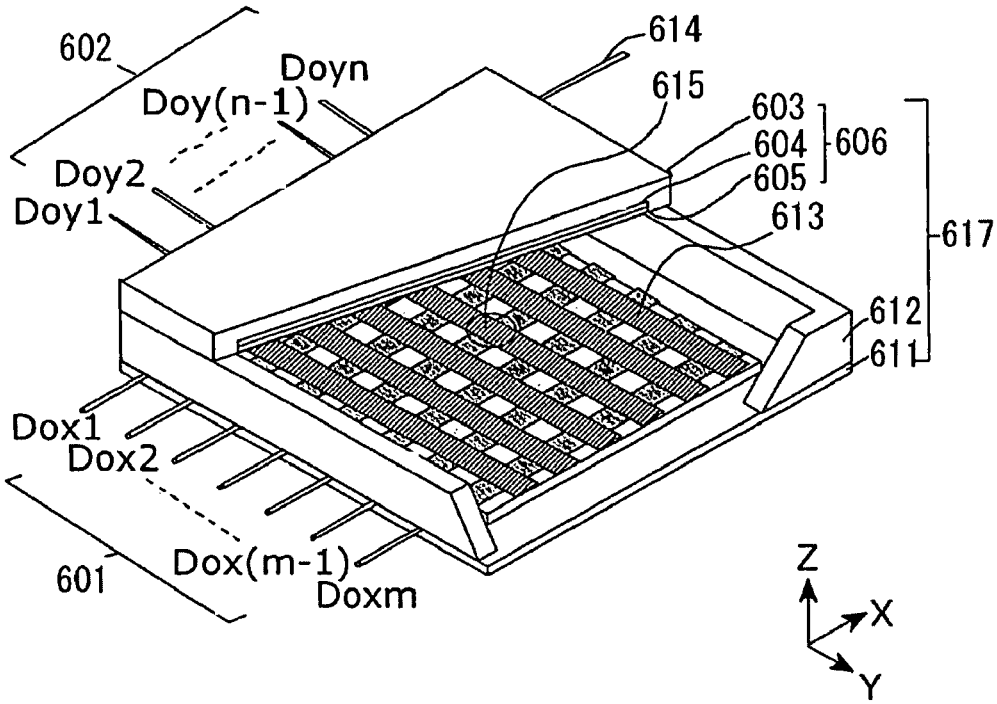
FIG. 6 is a schematic view showing a structure of an image display apparatus.

In the above-described configuration, by using a simple matrix wiring, each device is selected and each device can be individually driven. An image display apparatus, which is configured by using the electron source, will be described with reference to FIG. 6. FIG. 6 is a schematic view showing an example of a display panel of an image display apparatus.

As shown in FIG. 6, the image display apparatus is provided with an X-directional container external terminal 601, a Y-directional container external terminal 602, a electron source base substrate 613, a rear plate 611, a face plate 606, and a support frame 612. Further, the electron source base substrate 613 has a plurality of electron-emitting devices 615, and the rear plate 611 serves to fix the electron source base substrate 613. The face plate 606 is formed in such a manner that a phosphor film 604 as a phosphor that is an image forming member (a light-emitting member, which emits light due to irradiation of electrons) and a metal back 605 or the like are formed on the inner surface of a glass substrate 603. The rear plate 611 and the face plate 606 are connected to the support frame 612 by using a flit glass or the like. For example, an external container 617 is sealed and configured by burning the external container for more than ten minutes in a temperature range of 400° C. to 500° C., in the air or nitrogen.

The above-described image display apparatus may apply a voltage to each electron-emitting device 615 via container external terminals Dox1 to Doxm and Doy1 to Doyn. Each electron-emitting device 615 may emit an electron in accordance with the applied voltage.

By applying a high voltage to the metal back 605 or a transparent electrode (not illustrated) via a high voltage terminal 614, the emitted electron is accelerated.

The accelerated electron may crash into the phosphor film 604. Thereby, the phosphor film 604 emits light and an image is formed.

The image display apparatus according to the present embodiment can be also used as an image display apparatus or the like as an optical printer that is configured by using a photosensitive drum or the like other than a display apparatus for TV broadcasting and a display apparatus of a teleconference system and a computer or the like.

First Example

Hereinafter, a step of manufacturing an electron-emitting film according to the present example will be described in detail with reference to FIG. 1.

(Step 1)

At first, a quartz glass as the substrate 101 is sufficiently cleaned, and by a sputtering method, a film of Pt being a thickness of 200 nm as the cathode electrode 102 is formed on the substrate 101.

(Step 2)

By using a co-sputtering method, a diamond-like carbon film containing Pt is formed as the electron-emitting film 103 on the cathode electrode 102. The film thickness is about 30 nm, and a Pt density is about 20%.

(Step 3)

The surface termination processing is carried out under the following conditions to form the hydrogen terminated surface 104.

Processing gas: $CH_4$ 50 sccm
Pressure: 0.25 Pa
ECR plasma power: 300 W
Grid Bias: −80 V
Substrate Bias: +40 V
Processing Time: 30 seconds (Step 4)

With respect to this electron-emitting film, an electron emission characteristic is measured. The anode electrode is arranged so as to be parallel and flat to the electron-emitting film. The electron emission characteristic is measured with interval between the electron-emitting film and the anode electrode being 100 μm. As a result of evaluation of the property, it is possible to obtain an electron emission current of about 10 mA/cm$^2$ in an electric filed of 55 V/μm.

Second Embodiment

Hereinafter, a step of manufacturing an electron-emitting film according to the present example will be described in detail with reference to FIG. 1.

(Step 1)

At first, a quartz glass as the substrate 101 is sufficiently cleaned, and by a sputtering method, a film of Pt being a thickness of 200 nm as the cathode electrode 102 is formed on the substrate 101.

(Step 2)

By using a co-sputtering method, a diamond-like carbon film containing Co is formed as the electron-emitting film 103 on the cathode electrode 102. The film thickness is about 30 nm, and a Co density is about 20%.

(Step 3)

The surface termination processing is carried out under the following conditions to form the hydrogen terminated surface 104.

Processing gas: $CH_4$ 20 sccm
$H_2$ 30 sccm
Pressure: 0.25 Pa
ECR plasma power: 400 W
Grid Bias: 0 V
Substrate Bias: +40 V
Processing Time: 30 seconds (Step 4)

With respect to this electron-emitting film, an electron emission characteristic is measured. The anode electrode is arranged so as to be parallel and flat to the electron-emitting film. The electron emission characteristic is measured with interval between the electron-emitting film and the anode electrode being 100 μm. As a result of evaluation of the property, it is possible to obtain an electron emission current of about 10 mA/cm$^2$ in an electric filed of 40 V/μm.

Third Embodiment

Hereinafter, a step of manufacturing an electron-emitting film according to the present example will be described in detail with reference to FIG. 1.

(Step 1)

At first, a quartz glass as the substrate 101 is sufficiently cleaned, and by a sputtering method, a film of Pt of a thickness 200 nm as the cathode electrode 102 is formed on the substrate 101.

(Step 2)

By using a filament CVD method, a carbon film is formed on the cathode electrode 102. After that, injecting Co of 1 atm % into a diamond-like carbon film by using an ion injection method, an electron-emitting film is formed. The film thickness is about 30 nm.

(Step 3)

The surface termination processing is carried out under the following conditions to form the hydrogen terminated surface 104.

Processing gas: $C_2H_4$ 30 sccm
$H_2$ 20 sccm
Pressure: 0.25 Pa
ECR plasma power: 300 W
Grid Bias: 0 V
Substrate Bias: 20 V
Processing Time: 20 seconds (Step 4)

With respect to this electron-emitting film, an electron emission characteristic is measured. The anode electrode is arranged so as to be parallel and flat to the electron-emitting film. The electron emission characteristic is measured with interval between the electron-emitting film and the anode electrode being 100 μm. As a result of evaluation of the property, it is possible to obtain an electron emission current of about 12 mA/cm$^2$ in an electric filed of 40 V/μm.

Fourth Example

Hereinafter, a step of manufacturing an electron-emitting device according to the present example will be described in detail with reference to FIG. 2.

(Step 1)

At first, a quartz glass as the substrate 201 is sufficiently cleaned, and by a sputtering method, a film of Pt being a thickness of 200 nm as the cathode electrode 202 is formed on the substrate 201.

(Step 2)

By using a co-sputtering method, a diamond-like carbon film containing Co is formed as the electron-emitting film 203 on the cathode electrode 202. The film thickness is about 30 nm, and a Co density is about 25%.

(Step 3)

Next, in order to form the insulating layer 204, by a plasma CVD method using $SiH_4$ and $N_2O$ as a raw material gas, a film of $SiO_2$ is formed about 1,000 nm.

(Step 4)

Next, a film of Pt as the gate electrode 205 is formed on the insulating layer 204 by using a sputtering method so as to be a thickness of 100 nm.

(Step 5)

Next, exposing and developing a spin coating and a photoresist pattern of a positive-type photoresist (OFPR5000/ manufactured by Tokyo Ohka Kogyo Co., Ltd.) by a photolithography, a mask pattern 206 is formed. An opening diameter of a resist is determined to be 5 μm.

(Step 6)

Next, Pt is etched under such a condition that an etching gas is Ar gas, an etching power is 200 W, and an etching pressure is 1 Pa. Then, under such a condition that an etching gas is a mixture gas of $CF_4$ and $H_2$, an etching power is 150 W, and an etching pressure is 1.5 Pa, a dry etching is carried out and this etching is stopped in approximately a center portion of the insulating layer 204.

(Step 7)

Next, removing the remained mask pattern by a removing liquid (manufactured by Tokyo Ohka Kogyo Co., Ltd.), and then, soaking a device in BHF, $SiO_2$ on the upper surface of the electron-emitting film is wet-etched. Then, the device is cleaned with water for 10 minutes.

(Step 8)

The surface termination processing is carried out under the following conditions and a hydrogen terminated surface 207 is formed so as to complete the electron-emitting device.

Processing gas: $CH_4$ 50 sccm
Pressure: 0.25 Pa
ECR plasma power: 300 W
Grid Bias: 0 V
Substrate Bias: +40 V
Processing Time: 40 seconds As shown in FIG. 4, this device is arranged in a vacuum container and the anode electrode of a phosphor is set above the device. A direct current voltage of 5 kV is applied to the anode electrode, and a pulse voltage of 10 V is applied between the cathode electrode and the gate electrode. As a result, in synchronization with a pulse signal, emission of electrons is observed.

Further, without limiting on the conditions of the example, based on the base substrate obtained according to the first to third examples, an electron-emitting device may be manufactured. The condition may be appropriately changed.

Fifth Example

An image display apparatus using the electron-emitting device according to the fourth example is manufactured. The wiring is made by connecting the X-directional wiring to the cathode electrode 202 and connecting the Y-directional wiring to the gate electrode 205, respectively, as shown in FIG. 5. The electron-emitting device is arranged at a pitch of 30 μm in width and 30 μm in length with 144 pieces of openings made into one pixel. Above the device, a phosphor is aligned and arranged at a position 1 mm apart. A voltage of 5 V is applied the phosphor. The matrix is composed of 300×200 pixels, and on each pixel, 144 pieces of electron-emitting devices are formed.

Inputting a pulse signal of 18 V as an input signal, a high-definition image can be formed.

As described above, according to the embodiment, by terminating the surface of the electron-emitting film and the surface of the electron-emitting film of the electron-emitting device with hydrogen, emission of an electron with a small electron beam diameter can be made in a low electric field. Further, it is possible to obtain an electron-emitting device, which can make an efficient emission of electron at a low voltage and of which manufacturing process is simple. In addition, if the electron-emitting device according to the present invention is applied to the electron source and the image display apparatus, it is possible to realize an electron source and the image display apparatus with an excellent capability.

While the present invention has been described with reference to exemplary embodiment, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-276269, filed on Oct. 24, 2007, which is hereby incorporated by reference herein in its entirety.

What is claimed is:

1. A manufacturing method of an electron-emitting device comprising the steps of:

preparing a base substrate provided with an insulating or semi-conducting layer in advance; and exposing the layer to an atmosphere which contains neutral radical containing hydrogen wherein, compared with a density of a charged particle in the atmosphere, a density of the neutral radical containing hydrogen in the atmosphere is more than 1000 times.

2. A manufacturing method of an electron-emitting device according to claim 1, wherein the insulating or semi-conducting layer contains metal particles.

3. A manufacturing method of an electron-emitting device according to claim 2, wherein a density of the metal particle in the layer is not less than $1 \times 10^{14}/cm^3$ and not more than $1 \times 10^{19}/cm^3$.

4. A manufacturing method of an electron-emitting device according to claim 1, wherein the insulating or semi-conducting layer is a film containing carbon as a main component.

5. A manufacturing method of an electron-emitting device according to claim 4, wherein the insulating or semi-conducting layer contains graphite, a diamond-like carbon, an amorphous carbon, or a hydrogenated amorphous carbon, or a mixture thereof.

6. A manufacturing method of an electron-emitting device according to claim 1, wherein the neutral radical containing hydrogen contains any of H., $CH_3$., $C_2H_5$., and $C_2H$.

7. A manufacturing method of an electron-emitting device according to claim 1, wherein the step of exposing the layer to the atmosphere which contains the neutral radical containing the hydrogen is a step of terminating the surface of the layer with hydrogen by using a plasma apparatus provided with a bias grid.

8. A manufacturing method of an electron-emitting device according to claim 7, wherein the bias grid is arranged above the surface of the base substrate.

9. An electron-emitting device, wherein the electron-emitting device is manufactured by the manufacturing method of an electron-emitting device according to claim 1.

10. An electron source, wherein the electron source comprises a plurality of electron-emitting devices, which are manufactured by the manufacturing method of an electron-emitting device according to claim 1.

11. An image display apparatus comprising:

an electron source having a plurality of electron-emitting devices, which are manufactured by the manufacturing method of an electron-emitting device according to claim 1; and a light-emitting member, which emits light due to irradiation of electrons.

* * * * *